US010520884B2

(12) United States Patent
Ikami et al.

(10) Patent No.: US 10,520,884 B2
(45) Date of Patent: Dec. 31, 2019

(54) CARTRIDGE AND IMAGE FORMING APPARATUS

(71) Applicant: CANON KABUSHIKI KAISHA, Tokyo (JP)

(72) Inventors: Yasukazu Ikami, Tokyo (JP); Yoshihiro Mitsui, Numazu (JP); Takuya Oka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/216,358

(22) Filed: Dec. 11, 2018

(65) Prior Publication Data

US 2019/0187609 A1 Jun. 20, 2019

(30) Foreign Application Priority Data

Dec. 15, 2017 (JP) ..... 2017-240747
Oct. 30, 2018 (JP) ..... 2018-204523

(51) Int. Cl.

| | |
|---|---|
| ***G03G 15/08*** | (2006.01) |
| ***G03G 21/18*** | (2006.01) |
| ***G03G 15/16*** | (2006.01) |
| ***G03G 21/00*** | (2006.01) |
| ***G03G 9/097*** | (2006.01) |

(Continued)

(52) U.S. Cl.

CPC ..... *G03G 21/1814* (2013.01); *G03G 9/0819* (2013.01); *G03G 9/09716* (2013.01); *G03G 9/09725* (2013.01); *G03G 15/0216* (2013.01); *G03G 15/161* (2013.01); *G03G 21/0011* (2013.01); *G03G 21/0094* (2013.01);

(Continued)

(58) Field of Classification Search

USPC ..... 399/174

See application file for complete search history.

(56) References Cited

U.S. PATENT DOCUMENTS

2013/0109072 A1* 5/2013 Tsunoda ..... C01B 37/00 435/176
2015/0277253 A1 10/2015 Kawakami et al.

(Continued)

FOREIGN PATENT DOCUMENTS

JP 2003-280255 A 10/2003
JP 2004109461 A 4/2004

(Continued)

*Primary Examiner* — Quana Grainger

(74) *Attorney, Agent, or Firm* — Canon U.S.A., Inc. IP Division

(57) ABSTRACT

A cartridge includes a cleaning member configured to retain specific particles having a smaller equivalent sphere diameter than toner particles at a contact region. The specific particles contain an organosilicon polymer having a partial structure represented by R—$SiO_{3/2}$, wherein R represents an alkyl group having 1 to 6 carbon atoms. The atomic concentration dSi of silicon in the specific particles satisfies 1.0 atomic %≤dSi≤29.0 atomic % when the total atomic concentration of silicon, oxygen, and carbon in the specific particles is measured to be 100.0 atomic % by electron spectroscopy for chemical analysis (ESCA). Also, the specific particles satisfy L2/L3≤3/4 or L2/L3≥4/3 when assuming that the specific particles have three lengths L1, L2, and L3 in three axis directions in a three-dimensional coordinate system, wherein L1 is the longest one of the three lengths, in an average value of a unit volume.

15 Claims, 6 Drawing Sheets

(51) Int. Cl.
*G03G 9/08* (2006.01)
*G03G 15/02* (2006.01)

(52) U.S. Cl.
CPC ..... *G03G 2215/1661* (2013.01); *G03G 2221/0005* (2013.01)

(56) References Cited

U.S. PATENT DOCUMENTS

| | | | |
|---|---|---|---|
| 2016/0299447 | A1 | 10/2016 | Masumoto et al. |
| 2017/0212469 | A1 | 7/2017 | Kawakami et al. |

FOREIGN PATENT DOCUMENTS

| | | | |
|---|---|---|---|
| JP | 2009109573 | A | 5/2009 |
| JP | 2015-22078 | A | 2/2015 |
| JP | 2016-38591 | A | 3/2016 |

* cited by examiner

FIG. 4A
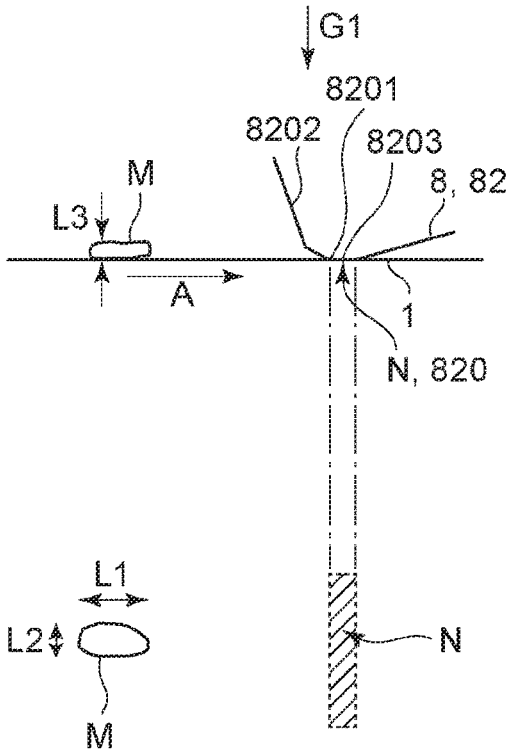
FIG. 4B
FIG. 4C
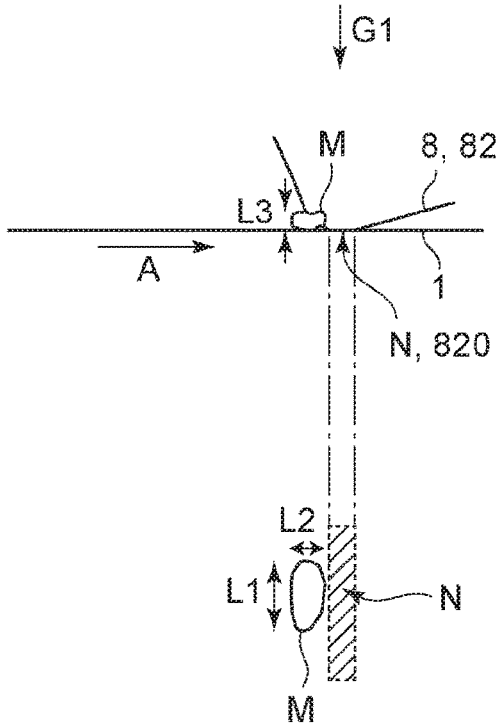
FIG. 4D

CARTRIDGE AND IMAGE FORMING APPARATUS

BACKGROUND OF THE INVENTION

Field of the Invention

The present disclosure relates to a cartridge used in electrophotographic image forming apparatuses and to an image forming apparatus.

Description of the Related Art

In general, image forming apparatuses include a photosensitive drum, an intermediate transfer belt (intermediate transfer member), and other members. Image forming apparatuses further include a cleaning blade to remove toner (residual toner) remaining on the photosensitive drum or the intermediate transfer member after transfer. The residual toner is collected from the photosensitive drum or the intermediate transfer member into a tonner collection container by bringing the free end of the cleaning blade into contact with the photosensitive drum or the intermediate transfer belt.

In order to increase toner collection performance, the region (cleaning nip) at which the cleaning blade and the photosensitive drum or the intermediate transfer member come into contact with each other is kept at a predetermined pressure (contact pressure) or more. On the other hand, a low torque is desirable at the contact region in view of the lifetime of the photosensitive drum or the intermediate transfer belt.

From the viewpoint of reducing the torque at the contact region, Japanese Patent Laid-Open No. 2015-22078 discloses a concept using a developer containing a toner and silica particles added. as an external additive, and in which a lubricant is applied onto the surface of the photosensitive drum.

Also, Japanese Patent Laid-Open No. 2003-280255 discloses a concept using a developer containing a toner containing an external additive, in which at least 1% of the external additive is separated from the toner particles and delivered as a lubricant to the contact region (nip portion), thereby reducing the torque at the contact region.

In both cases disclosed in the above-cited documents, the particles of the external additive present in the contact region (cleaning nip) function as very small rollers to reduce the torque. Unfortunately, the external additive gradually migrates downstream in the rotational direction of the photosensitive drum from the cleaning nip with the passage of time and contaminates the charging member located downstream from the photosensitive drum. This may a cause of defects, such as inconsistencies in density, in the resulting image.

SUMMARY OF THE INVENTION

Accordingly, the present disclosure provides a cartridge and an image forming apparatus that can form images including few defects while reducing the torque at the cleaning nip.

The cartridge includes an image bearing member operable to bear a developer image formed by developing an electrostatic latent image with a developer containing toner particles and specific particles, the specific particles having a smaller equivalent sphere diameter than the toner particles, and a cleaning member having a contact portion that is operable to contact with the image bearing member in a contact region and is operable to clean the surface of the image bearing member. The cleaning member is configured to be able to retain the specific particles in the contact region. The specific particles contain an organosilicon polymer having a partial structure represented by R—$SiO_{3/2}$, wherein R represents an alkyl group having 1 to 6 carbon atoms, and the atomic concentration dSi of silicon in the specific particles satisfies the relationship 1.0 atomic % ≤dSi≤29.0 atomic %, when the total atomic concentration of silicon, oxygen, and carbon in the specific particles is measured to be 100.0 atomic % by electron spectroscopy for chemical analysis (ESCA). Also, the specific particles satisfy L2/L3≤3/4 or L2/L3≥4/3, when assuming that the specific particles have three lengths L1, L2, and L3 in three axis directions in a three-dimensional coordinate system, wherein L1 is the longest one of the three lengths, in an average value of a unit volume.

An image forming apparatus is also provided which includes a fixing device and the above-described cartridge.

Furthermore, an image forming apparatus is provided according to another embodiment of the present disclosure. The image forming apparatus includes an image bearing member operable to bear a developer image formed by development using a developer containing toner particles and specific particles, the specific particles having a smaller equivalent sphere diameter than the toner particles, an intermediate transfer member operable to bear the developer image transferred from the image bearing member, and a cleaning member having a contact portion that is operable to contact with the intermediate transfer member in a contact region and is operable to clean the surface of the intermediate transfer member. The cleaning member is configured to be able to retain the specific particles in the contact portion. The specific particles contain an organosilicon polymer having a partial structure represented by R—$SiO_{3/2}$, wherein R represents an alkyl group having 1 to 6 carbon atoms, and the atomic concentration dSi of silicon in the specific particles satisfies the relationship 1.0 atomic %≤dSi≤29.0 atomic %, when the total atomic concentration of silicon, oxygen, and carbon in the specific particles is measured to be 100.0 atomic % by electron spectroscopy for chemical analysis (ESCA). Also, the specific particles satisfy L2/L3≤3/4 or L2/L3≥4/3 when assuming that the specific particles have three lengths L1, L2, and L3 in three axis directions in a three-dimensional coordinate system, wherein L1 is the longest one of the three lengths, in an average value of a unit volume.

Further features of the present invention will become apparent from the following description of exemplary embodiments with reference to the attached drawings.

BRIEF DESCRIPTION OF THE DRAWINGS

FIGS. 4A to 4D are conceptual representations illustrating the relation between the contact portion of the cleaning member of the image forming apparatus according to the first embodiment and the orientation of the specific particles.

DESCRIPTION OF THE EMBODIMENTS

The concept of the present disclosure may be embodied in a cartridge or an image forming apparatus.

An electrophotographic image forming apparatus 100 using a cartridge (for example, a process cartridge) according to the present disclosure will now be described with reference to the drawings. It should be noted that the following embodiments are intended merely to describe some implementations of the concept of the present disclosure and that the dimensions, materials, shapes, relative positions, and other features of the components of the apparatus and the cartridge are not limited to those described below unless otherwise specified, The electrophotographic image forming apparatus mentioned herein forms imagery on a recording medium by an electrophotographic image forming technique and may be implemented as, for example, an electrophotographic copy machine, an electrophotographic printer (such as a laser beam printer or an LED printer), a facsimile machine, a word processer, and the like. The image forming apparatus may include other members or components, such as a fixing device.

Also, the cartridge mentioned herein is a structure including a photosensitive drum and a cleaning member operable to clean the photosensitive drum in a housing and is removably mounted in the electrophotographic image forming apparatus.

The cartridge may further include at least one of the process devices including a charging device, a developing device, and a cleaning device. The cartridge including a process device may be referred to as a process cartridge.

First Embodiment

Electrophotographic Image Forming Apparatus

Figure 1:
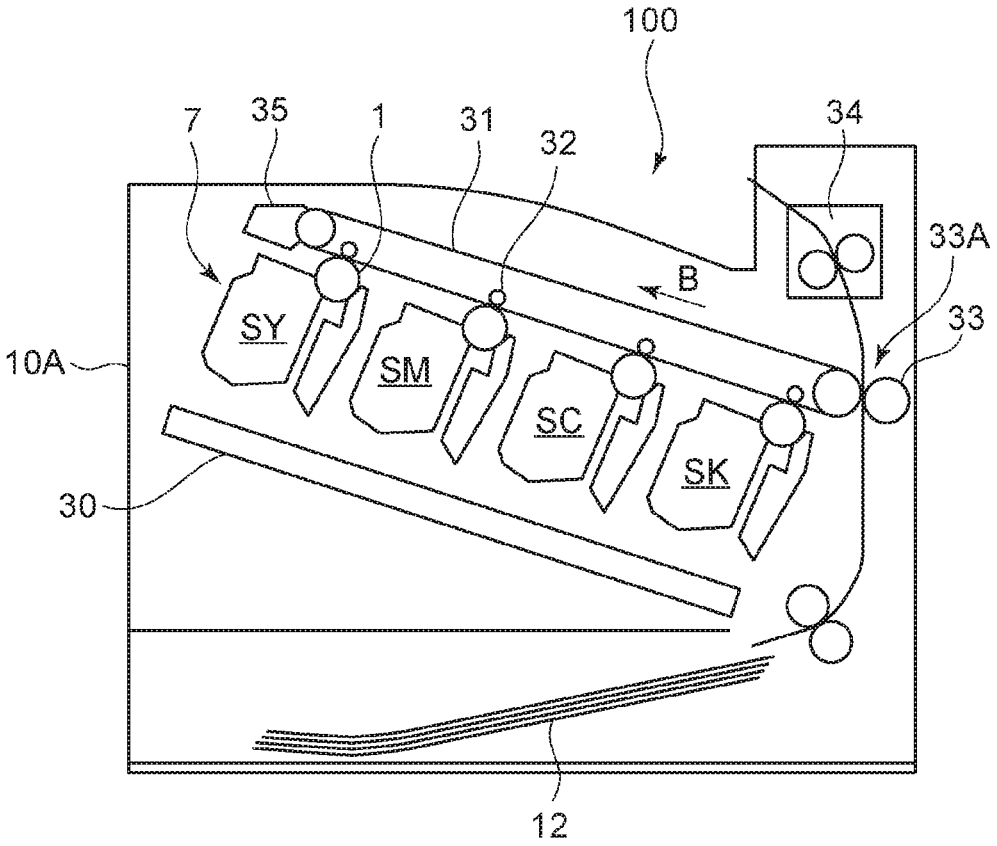
FIG. 1 is a schematic sectional view of an image forming apparatus according to a first embodiment of the present disclosure.

The overall structure of the electrophotographic image forming apparatus according to a first embodiment of the present disclosure will now be described. FIG. 1 is a schematic sectional view of an electrophotographic image forming apparatus (hereinafter simply referred to as the image forming apparatus) 100 according to a first embodiment.

The image forming apparatus 100 is a laser beam full color tandem printer using an intermediate transfer system. The image forming apparatus 100 uses a process cartridge (cartridge) 7 including a photosensitive member unit 13, and a cleaning device (a cleaning blade 8) (see FIG. 2) that is at least configuring a part of the photosensitive member unit 13 will be described herein later. In the present embodiment, the cleaning device (the cleaning blade 8) may be used in a printer configured to form imagery having a plurality of colors or in a monochrome printer configured to form monochrome (for example, black) imagery.

The image forming apparatus 100 can form full color images on a recording medium (for example, a recording paper sheet, a plastic sheet, or a cloth sheet) according to image information.

Image information is input to the apparatus body 10A of the image forming apparatus 100 from an image reading device (not shown) connected to the apparatus body 10A or a host device (not shown), such as a personal computer, connected to the apparatus body 10A for communication.

The image forming apparatus 100 includes process cartridges 7 functioning as a plurality of image forming sections that form images. The process cartridges 7 each include one of image forming sections SY, SM, SC, and SK configured to form a yellow (Y) image, a magenta (M) image, a cyan (C) image, and a black (K) image, respectively. In the present embodiment, the image forming sections SY, SM, SC, and SK are arranged in a raw in a direction intersecting the vertical direction.

In the present embodiment, each image forming section has a photosensitive drum 1 functioning as an image bearing member operable to bear an electrostatic image (electrostatic latent image). The photosensitive drum 1 is driven for rotation by a driving device or driving source (not shown). A scanner unit (exposure device) 30 is disposed around the photosensitive drums 1. The scanner unit 30 is an exposure device that irradiates the photosensitive drums 1 with a laser beam according to image information to form electrostatic image (electrostatic latent image) on the photosensitive drums 1.

The four photosensitive drums 1 each oppose an intermediate transfer belt 31 functioning as an intermediate transfer member operable to transfer toner images (developer images) into which the electrostatic images on the photosensitive drums 1 have been developed with a toner T (developer) to a recording medium 12. The intermediate transfer belt 31 is an endless belt and rotatably moves in the direction B shown in FIG. 1 (counterclockwise) in contact with all the photosensitive drums 1.

In the embodiments of the present disclosure, the toner may be used as a developer, or a developer prepared by mixing a toner with a magnetic carrier may be used as a developer.

The toner may include toner particles and further particles as an external additive.

In the present embodiment, the toner used in the developer is a magnetic monocomponent toner.

Also, four primary transfer rollers 32 are disposed as primary transfer devices on the inner surface of the intermediate transfer belt 31, each opposing one of the photosensitive drums 1. A voltage having a polarity opposite to the polarity of the normal charge of the toner is applied to the primary transfer rollers 32 from a primary transfer bias power source (high voltage power source, not shown) functioning as a primary transfer bias application device. Thus, the toner images on the photosensitive drums 1 are transferred onto the intermediate transfer belt 31 (primary transfer).

Also, the intermediate transfer belt 31 is provided with a secondary transfer roller 33 functioning as a secondary transfer device on the external surface thereof. A voltage having a polarity opposite to the polarity of the normal charge of the toner is applied to the secondary transfer roller 33 from a secondary transfer bias power source (high voltage power source, not shown) functioning as a secondary transfer bias application device. Thus, the toner images on the intermediate transfer belt 31 are transferred onto a recording medium 12 (secondary transfer).

For example, for forming a full color image in the process just described, the image forming sections SY, SM, SC, and SK form the respective color images in this order, and the color images are primarily transferred so as to be superposed one after another on the intermediate transfer belt 31.

Then, a recording medium 12 is conveyed, in synchronization with the movement of the intermediate transfer belt 31, to a secondary transfer portion 33A at which the secondary transfer roller 33 and the intermediate transfer belt 31 oppose each other. Thus, the four superposed color images on the intermediate transfer belt 31 are secondarily transferred at one time onto the recording medium 12 with the secondary transfer roller 33 abutting on the intermediate transfer belt 31 with the recording medium 12 therebetween.

The toner remaining on the intermediate transfer belt 31 without being transferred to the recording medium 12 with the secondary transfer roller 33 is conveyed to an intermediate transfer belt cleaning device 35 and removed.

The recording medium 12 having the transferred toner images is conveyed to a fixing device 34. The fixing device 34 applies heat and pressure to the recording medium 12 to fix the toner images on the recording medium 12, thus completing an image forming process.

Process Cartridge

Next, the overall structure of the process cartridge 7 (cartridge) mounted in the image forming apparatus 100 of the present embodiment will now be described with reference to FIG. 2.

Figure 2:
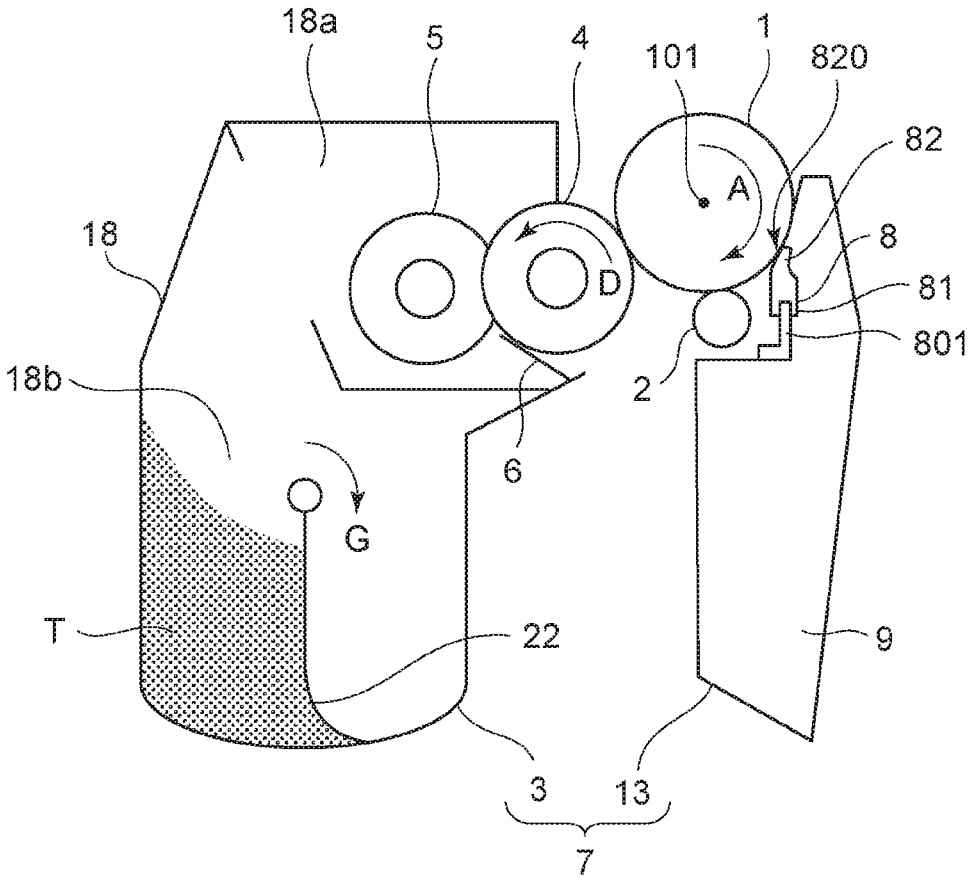
FIG. 2 is a schematic sectional view of a process cartridge of the image forming apparatus according to the first embodiment.

FIG. 2 is a schematic sectional view of the process cartridge of the image forming apparatus according to the first embodiment. More specifically, FIG. 2 illustrates a cross section (major cross section) of the process cartridge 7 viewed in the direction along the axis 101 on which the photosensitive drum 1 rotates.

The process cartridge 7 is removably mounted in the image forming apparatus 100 by using a mounting member, such as a mounting guide (not shown) or a positioning member (not shown) in the apparatus body 10A.

In the present embodiment, the process cartridges 7 for each color have the same shape and each contain one of the yellow (Y), magenta (M), cyan (C), and black (K) toners (developers).

Although the present embodiment uses such process cartridge, a developing unit 3 described herein later may be in a cartridge (developing cartridge) removably mounted solely in the apparatus body 10A. The process cartridges 7 used in the present embodiment are substantially the same in structure and operation, except for the color of the toner (developer) contained therein.

In the present embodiment, the process cartridge 7 includes a developing unit 3 including a developing roller 4, and a photosensitive member unit 13 including a photosensitive drum 1, The developing unit 3 has a developing chamber 18*a* and a developer container 18*b*. The developer container 18*b* is located below the developing chamber 18*a*. The developer container 18*b* contains a toner T as a developer.

The developing container 18*b* is provided with a toner conveying member 22 operable to convey the toner T to the developing chamber 18*a*. The toner conveying member 22 rotates in direction G as shown in FIG. 2, thereby conveying the toner T from the developer container 18*b* to the developing chamber 18*a*.

The developer container 18*a* is also provided with the developing roller 4 functioning as a developer bearing member, as shown in FIG. 2. The developing roller 4 is rotated in direction D in contact with the photosensitive drum 1, In the present embodiment, the developing roller 4 and the photosensitive drum 1 rotate in such a manner that the surfaces thereof move in the same direction at the position (contact region) at which they oppose each other.

The developing chamber 18*a* is provided with a toner feed roller 5 (hereinafter simply referred to as the feed roller) as a developer feed member therein. The toner feed roller 5 feeds the toner conveyed from the developer container 18*b* to the developing roller 4. The developing chamber 18*a* is also provided with a developer amount control member 6 operable to control the amount of the toner applied onto the developing roller 4 by the feed roller 5 and further operable to electrically charge the toner.

The developing roller 4, the feed roller 5, and the developer amount control member 6 each receive a voltage independently from a high voltage power source (not shown) of the apparatus body 10A.

The toner fed onto the developing roller 4 by the feed roller 5 is delivered to the contact portion of the developing roller 4 with the developer amount control member 6 by the rotation of the developing roller 4 and triboelectrically charged by friction between the developing roller 4 and the developer amount control member 6. On charging, the thickness of the toner layer is also controlled. The toner layer (toner) on the developing roller 4 controlled (and charged) by the developer amount control member 6 is conveyed to the portion abutting the photosensitive drum 1 by the rotation of the developing roller 4. The toner conveyed to this portion develops an electrostatic image on the photosensitive drum 1 into a visible toner image.

For the photosensitive member unit 13, the photosensitive drum 1 is rotatably attached with a bearing (not shown). The photosensitive drum 1 is rotated in a direction indicated by arrow A by receiving a driving force of a drive motor.

The photosensitive member unit 13 also includes a charging roller 2 and a cleaning blade 8 that is an elastic plate. The charging roller 2 and the cleaning blade 8 are disposed so as to come into contact with the periphery of the photosensitive drum 1. The charging roller 2 has a mandrel to which a voltage is applied from the high voltage power source (not shown) of the apparatus body to charge the surface of the photosensitive drum 1 to a predetermined potential.

In the present embodiment, the cleaning blade 8 (cleaning member) is configured so that one end (fixed end) 81 thereof is secured to the metal plate 801, while the other end 82 (free end) comes into contact with the photosensitive drum 1 to be cleaned, as shown in FIG. 2.

More specifically, the cleaning blade 8 is made of an elastic plate and has a contact portion 820 at the free end 82 that conies into contact with the surface of the photosensitive drum 1. The surface of the photosensitive drum 1 and the contact portion 820 of the cleaning blade 8 define a cleaning nip N (contact region) therebetween.

The cleaning blade 8 can retain specific particles M having a smaller equivalent sphere diameter than toner particles of the toner T in the contact region N in which the photosensitive drum 1 and the contact portion 820 come into contact with each other, as will be described herein later.

The cleaning blade 8 rubs the surface of the photosensitive drum 1 to scrape toner particles and fine specific particles M remaining on the drum after transfer with the contact portion 820 of the cleaning blade 8 at the free end 82. Thus, the charging member 2 downstream from the contact portion 820 in the rotational direction A is prevented from being contaminated with the toner particles of the toner T and the fine specific particles M, and the remaining toner is prevented from spreading over the surface of the photosensitive drum and causing defects in the resulting image.

The cleaning blade 8 also removes corona products (not shown) attached to the surface of the photosensitive drum 1 during charging, thereby alleviating the increase of friction on the surface of the photosensitive drum 1. The toner removed by the cleaning blade 8 is collected in a toner collection container 9 disposed below the cleaning blade 8.

Reduction in Torque at Cleaning Nip

Figure 3A:
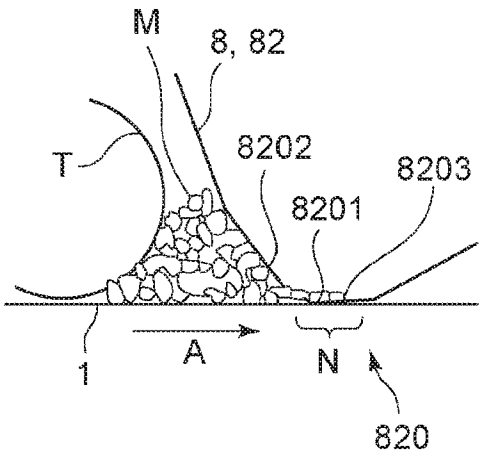
FIG. 3A is a schematically enlarged view of the contact region between the drum and the contact portion of the cleaning member in the image forming apparatus of the first embodiment.
Figure 3B:
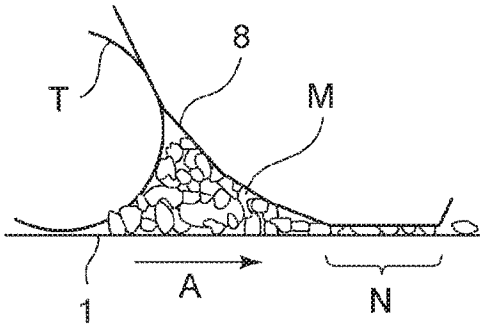
FIG. 3B is a schematically enlarged view of the contact region in Comparative Example 1.
Figure 3C:
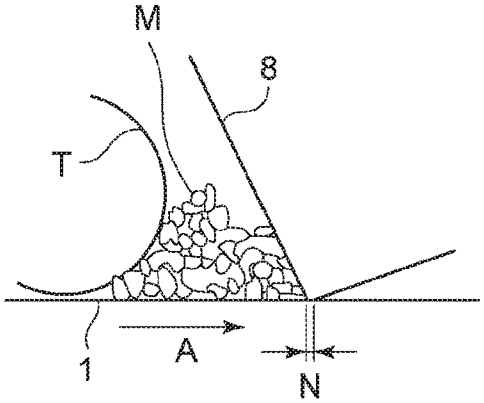
FIG. 3C is a schematically enlarged view of the contact region in Comparative Example 2.

Turning now to FIGS. 3A to 3C, the mechanism of torque generation at tl e nip between a cleaning member and a photosensitive drum is illustrated in detail.

FIG. 3A is an enlarged fragmentary view of the contact region (contact portion 820) between the cleaning member and the drum of the image forming apparatus of the first embodiment. FIGS. 3B and 3C are enlarged fragmentary views of the contact regions in Comparative Examples 1 and 2, respectively, for comparison with the present embodiment.

FIG. 3A shows sections of the cleaning member and the photosensitive drum viewed in a direction along the rotation axis 101 of the photosensitive drum 1 (see FIG. 2). As can be understood from FIG. 3A, the surface of the photosensitive drum 1 defines a cleaning nip N with the contact portion 820 at the free end 82 of the cleaning blade 8 while moving in direction A When particles M (specific particles) having a peculiar shape described herein later are fed to the cleaning nip N, the particles M are retained at the cleaning nip and exhibit a lubricity to reduce friction, thereby reducing the torque at the cleaning nip.

Since the particles M having a peculiar shape are retained at the cleaning nip N, the charging roller 2 and other members located downstream from the contact portion 820 in direction A (see FIG. 2) are less likely to be contaminated with the particles M.

The presence (retention) of the particles M at the cleaning nip N prevents the toner T remaining on the photosensitive drum 1 after primary transfer from coming close to or entering the cleaning nip N, as shown in FIG. 3A. Thus, the toner T is pre vented from passing through the cleaning nip N effectively.

Lubricity of Particles

Next, the lubricity (to reduce friction) of the specific particles M, which are used to reduce torque at the cleaning nip N, will be described.

It has been found that the material of the particles M should have a low surface free energy in order for the particles M in the cleaning nip N to reduce the friction or exhibit a lubricity between the cleaning blade 8 and the photosensitive drum 1.

The material having such a lubricity as can reduce friction may be an organosilicon polymer having a partial structure represented by R—$SiO_{3/2}$. In the formula, R represents an alkyl group having 1 to 6 carbon atoms.

A siloxane bond Si—O—Si in which two Si atoms share one oxygen atom is represented by "—$SiO_{1/2}$" and a unit in which a Si atom forms three siloxane bonds is represented by —$SiO_{3/2}$. Hence, in the partial structure represented by the above formula, one of the four bonding hands of the Si atom having a valence of 4 binds to R, and the others form three siloxane bonds.

Also, it has been found that particles M having a surface structure satisfying the following relationship when measure by X-ray photoelectron spectroscopy (electron spectroscopy for chemical analysis, ESCA) exhibit such a lubricity as can reduce friction effectively. Specifically, when the total of the atomic concentration dSi of silicon, the atomic concentration dO of oxygen, and the atomic concentration dC of carbon is measured to be 100.0 atomic %, the atomic concentration dSi of silicon satisfies the relationship 1.0 atomic %≤dSi≤29.0 atomic %.

By controlling the silicon atomic concentration dSi to 1.0 atomic % or more, the specific particles have silicon-rich surfaces that enable the particles exhibit such a lubricity as can reduce friction. Also, by controlling the silicon atomic concentration dSi to 29.0 atomic % or less, the structure of the specific particles M is kept stable.

Production of Particles M

The particles M may be produced by a sol-gel process, which is an exemplary process for producing organosilicon polymer.

In the sol-gel process, a metal aikoxide $M(OR)_n$ (wherein M represents a metal, O represents oxygen, R represents a hydrocarbon, and n represents the oxidation number of the metal), which is the starting material, is subjected to hydrolysis and polycondensation in a solvent, thus formed into a sol and then a gel. The sol-gel process is generally used to produce glass, ceramics, organic-inorganic hybrids, and nanocomposites. Also, the sol-gel process may be used to produce a substance in a bulk state, fibers, fine particles, or a functional material having those at the surface, in a liquid phase at low temperature.

The particles M may form a surface layer of the toner particles (base particles of the toner T), thus combined with the toner particles (base particles of the toner T) in advance. The particles M in the surface layer will separate from the base particle of the toner T by friction in development or the like, thus being solely fed to the cleaning nip N.

In at least some embodiment of the present disclosure, the organosilicon polymer forming the particles M present in advance over the surfaces of the base particles of the toner T is produced by hydrolysis and polycondensation of a silicon compound. such as alkoxysilane.

Shape (Dimensions) of Particles M

In the present embodiment, the particles M to be fed to the cleaning nip N have a smaller equivalent sphere diameter than the toner particles (base particles of the toner T). For example, when the base particles of the toner T are substantially spherical and have an equivalent sphere diameter of about 2 μm to 10 μm, the equivalent sphere diameter of the particles M may be 10 nm to 2 μm.

Particles M having an equivalent sphere diameter of less than 10 nm are not likely to be retained in the cleaning nip N nor exhibit satisfactory lubricity to reduce friction when the surface of the cleaning blade 8 or the photosensitive drum 1 is rough.

Also, by reducing the equivalent sphere diameter of the particles M to a size smaller than the equivalent sphere diameter of the toner T, as shown in FIG. 3A, the particles M having a lubricity to reduce friction can come close to the cleaning nip N prior to the toner T. Consequently, the toner T does not enter the cleaning nip N filled with the particles M.

The particles M have a peculiar shape. The particles M do not easily pass through the cleaning nip N and are easy to retain in the cleaning nip N, thus keeping a lubricity to reduce friction for a long time.

In the present embodiment, the peculiar shape is defined as follows.

The peculiar shape of the specific particles satisfies L2/L3≤3/4 or L2/L3≥4/3 when assuming that the specific particles have three lengths L1, L2, and L3 in three axis directions in a three-dimensional coordinate system, wherein L1 is the longest one of the three lengths, in an average value of a unit volume.

The average value of a unit volume is determined as described below.

The volume V of a particle M is roughly calculated by L1* L2*L3.

For example, 10 particles M define a unit. In this instance, each of the 10 particles has a value corresponding to L2/L3 or a value corresponding to V=L1* L2*L3. These values of the 10 particles M can he represented as follows:

V_1, (L2/L3)_1;
V_2, (L2/L3)_2;
V_3, (L2/L3)_3;
. . . ; and
V_10, (L2/L3)_10;

Also, the average value of L2/L3 in the unit volume, that is, (L2/L3)_ave, can be presented by as follows: (L2/L3)_ave={V_1*(L2/L3)_1+ . . . +V_10*(L2/L3)_10}/{V_1+ . . . +V_10}.

The larger the volume V of a particle, the more the particle influences the average values.

The mechanism (principle) for retaining the particles M having a peculiar shape described above in the cleaning nip N will now he described with reference to FIGS. 4A to 4D.

FIGS. 4A to 4D are conceptual representations illustrating the relation between the contact portion 820 of the cleaning member of the image forming apparatus according to the first embodiment and the orientation of a specific particle M.

FIG. 4A illustrates the cleaning nip N viewed in the direction along the axis 101 of the photosensitive drum 1 (see FIG. 2) and the vicinity thereof. FIG. 4B illustrates the positional relation between the particle M on the surface of the photosensitive drum and the cleaning nip N when viewed in the direction G1 shown in FIG. 4A (the direction along the normal to the periphery of the photosensitive drum 1), FIGS. 4A and 4B illustrate the state before the particle M enters the cleaning nip N (reaches the contact portion 820), FIG. 4C is a view similar to FIG. 4A, viewed in the direction along the axis 101 of the photosensitive drum 1. FIG. 4D is a view similar to FIG. 4B, viewed in the direction of G1. FIGS. 4C and 4D illustrate the state when the particle M has entered the cleaning nip N (has reached the contact portion 820).

As shown in FIG. 4A to 4D, the particle M having a peculiar shape moves in direction A accompanying the movement of the photosensitive drum 1 and enters the cleaning nip N. At this time, on coming into contact with the contact portion 820, the particle M changes the orientation thereof to a more stable orientation and stops in the cleaning nip N.

More specifically, it is thought that when the particle M receives a pressure (resistance) from the contact portion 820 at the entrance (front) of the cleaning nip N, a force is applied to the particle M so that the direction of the largest length L1 of the particle M is naturally aligned with the direction along a longitudinal direction (the axis 101 of the photosensitive drum 1). This state is shown in FIGS. 4C and 4D.

To form a particle M that does not easily roll in the direction A when it is in the state shown in FIGS. 4C and 4D, the lengths L2 and L3 of the particle M are desirably not the same.

The present inventors found the conditions enabling particle M that do not easily roll to be provided. Specifically, when the lengths L1, L2, and L3 of particles satisfy L2/L3≤3/4 or L2/L3≥4/3 in an average value of a unit volume, the particles do not easily roll in or pass through the cleaning nip N.

In other words, the particles M having a peculiar shape satisfying L2/L3≤3/4 or L2/L3≥4/3 are easy to bring into a stable orientation, accordingly easy to retain in the cleaning nip N, exhibiting a lubricity to reduce friction for a long time.

On the other hand, if particles have such lengths as L2/L3 is more than 3/4 and less than 4/3 in an average value of a unit volume, the particles easily roll and come into an unstable orientation due to the value of lengths L2 and L3 being close to each other, Accordingly, the particles M are kept from easily passing through the cleaning nip N, thus reducing contamination of the members (such as charging roller 2) downstream from the cleaning member with the particles and helping stable image formation.

The direction of length L1 shown in FIGS. 4A to 4D may be any one of the three X, Y, and Z axis directions of the three-dimensional coordinate system, and the direction of length L2 or L3 shown in FIGS. 4A to 4D may be replaced with the direction of length L1 (having the largest length).

Determination of the Shape of Particles M

The diameter of the particles M may be measured by scanning electron microscopy or dynamic light scattering. The shape of the particles may be determined by scanning probe microscopy (SPM), scanning electron microscopy (SEM), transmission electron microscope (STM), or a combination thereof.

Cleaning Blade

From the viewpoint of helping retain the particles M in the cleaning nip N, the dynamic hardness H of the cleaning blade 8 may be controlled as described below.

In the present embodiment, the cleaning blade 8 is defined by a rubber member 802 made of a urethane r ubber or a silicon rubber secured to a metal supporting plate (metal plate 801). The contact portion 820 of the cleaning blade 8 at the free end 82 may have a dynamic hardness H satisfying 0.1≤H≤1.2.

A cleaning blade having a dynamic hardness of 0.1 or more at the contact portion 820 can produce a high contact force at the cleaning nip N, preventing the particles M from passing through the cleaning nip N. In contrast, the contact portion 820 of a cleaning blade 8 having a dynamic hardness H of more than 1.2 is not bent much, and the degree of this bending is excessively small. Accordingly, the particles M is not likely to be retained in the cleaning nip N nor to exhibit a lubricity to reduce friction.

In some embodiments, the cleaning blade 8 may be made of a urethane rubber having a hardened surface and may have a dynamic hardness H of 0.1 to 1.2 at least at the contact portion 820. When such a cleaning blade 8 comes into contact with the photosensitive drum 1, the degree of the bending of the contact portion 820 is small, and accordingly, the nip width (N) between the cleaning blade 8 and the photosensitive drum 1 is not satisfactorily expanded. Accordingly, the maximum contact force of the cleaning blade is increased so that the particles do not pass through the cleaning nip and that the torque at the cleaning nip N is not much increased.

For a hardened region of the urethane rubber of the cleaning blade 8, a material to be hardened is previously applied to a predetermined region of the urethane rubber and is then hardened.

The material for forming the hardened region may be an isocyanate compound. The material for forming the hardened region may be diluted to a predetermined concentration with a solvent before use, if necessary. The material may be applied by, for example, dipping, spraying, or using a dispenser, a brush, or a roller.

In the present embodiment, the hardened region is both faces (8202, 8203) defining a contact edge 8201 therebetween at the contact portion 820. More specifically, the hardened region is the entirety of the face 8202 upstream from the contact edge 8201 in the direction A in which the surface of the photosensitive drum moves. For the face 8202 downstream in the direction A, the hardened region is a region from the contact edge 8201 to 2 mm or more.

Hardness Measurement of Cleaning Blade

The hardness of the hardened region of the contact portion 820 of the cleaning blade 8 may be measured as described below.

Dynamic Ultra Micro Hardness Tester DUH-W211S manufactured by Shimadzu may be used for the measurement. Also, a 115° triangular pyramid indenter may be used as the indenter, and the dynamic hardness (DHs) is calculated from the following equation:

$$\text{Dynamic hardness (DHs)}=\alpha\times P/D2$$

wherein α represents the constant depending on the shape of the indenter, P represents the test force (mN), and D represents the depth (pm) of indentation (depth of the indenter in the sample).

Measurement conditions are as follows:

α: 3.8584;

P: 1.0 mN;

load speed: 0.03 mN/s;

indentation time: 5 s;

measurement environment: temperature 23° C., relative humidity 55%; and sample aging: allowing the sample to stand in an environment with a temperature of 23° C. and a relative humidity of 55% for 6 hours.

Preparation of Test pieces

A procedure for preparing test samples will be described below by way of example.

A sample of the cleaning blade for test pieces is obtained by (1) dividing an image forming region on the cleaning blade into three same sample pieces in the longitudinal direction, and (2) cutting a portion of each sample piece by (i) 2 mm (4 mm in total) from the center of the sample piece toward both sides in the longitudinal direction and (ii) 2 mm from the edges in the width direction.

Each of the test pieces is set so that an indenter can perpendicularly touch the hardened surface in the hardened region of the sample. Thus, the hardness at 100 μm from the contact edge (contact portion 820) of the cleaning blade 8 with the photosensitive drum 1 is measured with the test piece at 2 mm from an end in the longitudinal direction.

This measurement is performed on the three test pieces, and the average of the three measurements is defined as the dynamic hardness H at the surface of the cleaning blade.

Particle M supply Section (Particle M Source)

For supplying the particles M to the cleaning nip N, a surface layer containing the particles M may be formed over the surfaces of the base particles of the toner T, as described above (Method 1). The particles M in the surface layer of the toner (base particles of toner T+particles M) will separate from the base particles of the toner T during delivering the toner to the developing roller, the photosensitive drum, and the cleaning nip N, thus being solely supplied to the cleaning nip N.

Hence, the particles M are delivered in a combined and integrated form with the base particles of the toner T from the developing roller 4 to the photosensitive drum 1 (and the cleaning nip N). After separating from the surfaces of the toner T during image forming operation, the particles M is delivered to the contact region (N) and retained in the contact region.

In this method, since the particles M is delivered in the state described above, the particle M supply section (particle M source) is defined by the toner T and the developing roller 4 (developer bearing member). This concept enables the particles M to be fed to the cleaning nip N with reliability over a long period.

As an alternative to method 1 in which the toner particles in the toner T are covered with a surface layer containing the particles M, the particles M may be added as an external additive to the toner T (method 2), More specifically, the particles M may be an additive contained with the toner particles in the toner T and may be delivered as a constituent of the toner T to the photosensitive drum 1 from the developing roller 4.

Alternatively, the particles M may be added in the surface of the developing roller 4 in advance so as to be fed to the photosensitive drum 1 from the developing roller 4.

In at least some embodiments, the developing roller 4 is an elastic roller capable of coming into contact intermittently with the photosensitive drum 1.

The foregoing method 1, which does not need a process step to externally add the particles M to the toner T, is beneficial in terms of saving cost. The method 1 may be combined with the method 2 of externally adding particles having a peculiar shape to the toner including base particles of the toner T covered with the surface layer containing the particles M (method 3).

EXPERIMENTAL EXAMPLES

Particles M (toners containing the particles M) used in the Experimental Examples will now be described.

Toner 1

The toner particles (covered with a surface layer containing particles M) of toner 1 were formed according to the following procedure.

Into a four-neck container equipped with a reflux tube, a stirrer, a thermometer, and a nitrogen inlet were added 700 parts by mass of ion-exchanged water, 1000 parts by mass of 0.1 mol/L $Na_3PO_4$ aqueous solution, and 24.0 parts by mass of 1.0 mol/L HCl aqueous solution. The contents in the container were held at 60° C. while being stirred at 12,000 rpm with a high-speed agitator TK-Homomixer. Into this container was slowly added 85 parts by mass of 1.0 mol/L $CaCl_2$ aqueous solution to prepare an aqueous dispersion medium containing very small particles of a poorly water-soluble dispersion stabilizer $Ca_3(PO_4)_2$.

Polymerizable monomer composition 1 was prepared by mixing and agitating the following constituents:

styrene: 70.0 parts by mass;

n-butyl acrylate: 30.0 parts by mass;

methyltriethoxysilane: 10.0 parts by mass;

copper phthalocyanine pigment (C.I. Pigment Blue 15:3): 6.5 parts by mass;

polyester resin (1): 4.0 parts by mass;

charge control agent 1 (aluminum 3,5-di-t-butylsalicylate): 0.5 part by mass;

charge control resin 1: 0.4 part by mass; and releasing agent (behenyl behenate, melting point 72.1° C.): 10.0 parts by mass.

These constituents were blended for dispersion with an attritor for 3 hours, and the resulting polymerizable monomer composition 1 was held at 60° C. for 20 minutes. Then, 16.0 parts by mass of t-butyl peroxypivalate (50% solution in toluene) was added as a polymerization initiator into polymerizable monomer composition 1. The resulting mixture was granulated in an aqueous medium for 10 minutes while being stirred at a rotational speed of 12,000 rpm with a high-speed agitator. Then, after the high-speed agitator was replaced with an agitator having a propeller stirring blade and the interior was heated to 70° C., the reaction system was subjected to a reaction for 5 hours while being slowly stirred. The pH of the aqueous medium at this time was 5.1.

Subsequently, 10.0 parts by mass of 1.0 mol/L sodium hydroxide aqueous solution was added to adjust the pH to 8.0, and the container was heated to 90° C. and held at this temperature for 7.5 hours. Then, 4.0 parts by mass of 10% hydrochloric acid solution and 50 parts by mass of ion-exchanged water were added to adjust the pH to 5.1.

Subsequently, 300 parts by mass of ion-exchanged water was added, and the reflux was replaced with a distillation instrument. The contents in the container were distilled at an interior temperature of 100° C. for 5 hours to yield polymer slurry 1. Distillation fraction was 300 parts by mass. After being cooled to 30° C., dilute hydrochloric acid was added to the container containing polymer slurry 1 to remove the dispersion stabilizer.

The reaction product was subjected to filtration, washing, and drying to yield toner particles having a weight-average particle size of 5.6 μm (having a surface layer containing particles M). These toner particles are used as toner 1.

The shape (dimensions) of the particles in the surface layer of toner 1 and the material and silicon atomic concentration in the surface layer are shown in Table 1. Toner 1 was observed by TEM for silicon mapping. As a result, it was confirmed that the surface layer evenly contained silicon atoms and that the surface layer was not a coating layer formed with aggregates of particles adhering to each other.

Toners 2 and 3 described below will be subjected to the same confirmation.

Toner 2

Unlike the above-described toner 1, toner 2 was produced by externally adding inorganic particles as an external additive to toner 1. For the external addition, 0.2 part of positively charged inorganic particles DHT-4A (produced by Kyowa Chemical) were externally added to 100 parts of toner T (particles of toner 1). The toner containing the external additive was agitated with a mixer SMP-2 (manufactured by Kawata) at 3000 rpm for 10 minutes to yield toner 2.

The particle of toners 1 and 2 includes a base particle and a coating layer (surface layer) of an organosilicon polymer (constituent of particles M) integrated with the base particle.

Toner 3

In contrast, toner 3 (Comparative Example) was prepared by adding inorganic particles as an external additive to a toner T whose particles were not covered with a surface layer containing particles M (being merely base particles). The inorganic particles added to toner 3 were produced according to the process described in Example 5 in Japanese Patent Laid-Open No. 2016-38591.

The shape (dimensions) of the toner particles and silicon atomic concentration in toners 1 to 3 were measured as described below.

The particle sizes of toners 1 to 3 may be determined by SPM under, for example, the following conditions:

scanning probe microscope (SPM): manufactured by Hitachi High-Tech Science;

measurement unit: E-sweep measurement mode: DFM (resonance mode) shape image resolution: number of X data=256, number of Y data=128; and measurement area: square, 1 μm on a side.

The length, the width, and the height of the particles M were derived from the measurement data by "3D gradient correction", and the largest size was defined as L1, the medium size was defined as L2, and the smallest size was defined as L3.

Thus, the L2/L3 value and the volume (V=L1*L2* L3) of each of particles M were calculated.

For the L2/L3 value in the measurement field of view, the average L2/L3 in a unit volume, (L2/L3)={V_1*(L2/L3)_1+ . . . +V_10*(L2/L3)_10}/{V_1+ . . . +V_10}, was calculated, using (L2/13)_i and V_i of each particle M (i=1 to 10), wherein {V_1*(L2/L3)_1 + . . . +V_10*(L2/L3)_10}=$Sum_{(i=1\text{-}10)}$ {V_i* (L2/13)_i} and {V_1+ . . . +V_10}=$Sum_{(i=1\text{-}10)}${V_i}.

The larger the volume V of a particle, the more the particle influences the L2/L3 value.

Next, samples of particles M to be measured will be described. The measurement samples were prepared according to the following procedure.

A concentrated sucrose solution is prepared by dissolving 160 g of sucrose (produced by Kishida Chemical) in 100 mL of ion-exchanged water being heated in hot water. A dispersion liquid is prepared by adding 31 g of the concentrated sucrose solution and 6 mL and Contaminon N (10 mass % aqueous solution of pH 7 neutral detergent for cleaning precision measuring instruments, containing a nonionic surfactant, an anionic surfactant, an organic builder, produced by Wako Pure Chemical Corporation) into a centrifuge tube.

Into the dispersion liquid, 1.0 g of toner (each of toners 1 to 3) is added, and aggregates of the toner particles are crushed with a spatula.

Subsequently, the dispersion liquid in the centrifuge tube is shaken at 350 spm (strokes per minute) for 20 minutes with a shaker. After shaking, the liquid is removed into a swing rotor glass tube (50 mL) and subjected to separation in a centrifuge at 3500 rpm for 30 minutes.

Thus, the toner is separated into toner particles (base particles) and the external additive. After visually ensuring that the toner and a liquid phase are sufficiently separated, the upper phase, or toner, is collected with a spatula or the like.

The collected toner is subjected to vacuum filtration and then dried for at least 1 hour, followed by collecting the toner particles (each of toners 1 to 3).

The procedure up to this is repeated several times until an amount of toner required for measurement is collected, Next, the measurement of the concentration of silicon in the particles M in the surface layer of the toner particles (of toners 1 to 3) will be described.

The surfaces of toner particles (of toners 1 to 3) are covered with particles M. Therefore, the composition of particles M fixed to the toner can be determined by the compositional analysis of the surfaces of the toner particles by surface X-ray photoelectron spectroscopy (electron spectroscopy for chemical analysis, ESCA), Hence, the concentration [dSi, atomic %] of silicon, the concentration [dC, atomic %] of carbon, and the concentration [dO, atomic %] of oxygen at the surface layer of particles M can he determined by measuring the surface layer of the toner particles.

For example, ESCA is performed under the following conditions:

Apparatus: Quantum 2000 manufactured by ULVAC-PHI

ESCA X-ray source: Al Kα

X-ray radiation: 100 μm, 25 W, 15 kV
raster: 300 μm×200 μm
Pass Energy: 58.70 eV
Step Size: 0.125 eV
neutralizing electron gun: 20 μA, 1 V Ar
ion gun: 7 mA, 10 V
number of sweeps: 15 for Si, 10 for C, 5 for O In the measurement disclosed herein, the concentrations [dSi], [dC], and [dO] of silicon, carbon, and oxygen at the surface layer of the toner particles were calculated from the peak strength of each element.

The results of ESCA measurements for particles M in the surface layer of toners 1 to 3 are shown in Table 1.

TABLE 1

| | Dimensions of particles | | | | | Silicon concentration |
|---|---|---|---|---|---|---|
| | L1 (length) | L2 (width) | L3 (height) | L2/L3 | Surface layer material | (atomic %) |
| Toner 1 | 120 | 120 | 40 | 3.0 | Organosilicon polymer | 23.4 |
| Toner 2 | 130 | 120 | 50 | 2.4 | Organosilicon polymer + Inorganic particles | 23.4 |
| Toner 3 | 80 | 80 | 80 | 1.0 | Inorganic particles | 33 |

The process cartridge 7 was charged with any of toners 1 to 3 Each toner, and the toner was applied onto the developing roller 4 by image forming operation (operation for feeding the toner). The photosensitive drum and the developing roller were brought into contact with each other to form a toner image on the photosensitive drum. Then, particles M separated from the surface layers of the particles of the toner not primarily transferred, which was the reversely charged or poorly charged portion of the toner, would be fed to the cleaning nip N.

A larger amount of particles M can be fed by setting the voltage applied to the primary transfer section to be lower than the voltage applied for normal image formation or to be opposite to the polarity of the voltage applied for normal image formation.

Next, the cleaning blade 8 used in the Experimental Examples will be described.

In the Experimental Examples, cleaning blades 1 to 6 each having a dynamic hardness H in the range of 0.08 to 1.3 shown in Table 2 were prepared.

TABLE 2

| | Dynamic hardness ($mN/\mu m^2$) |
|---|---|
| Cleaning blade 1 | 0.13 |
| Cleaning blade 2 | 0.29 |
| Cleaning blade 3 | 0.57 |
| Cleaning blade 4 | 1.09 |
| Cleaning blade 5 | 0.08 |
| Cleaning blade 6 | 1.3 |

Process cartridges 7 were each charged with any one of toner 1 to 3, and images were formed on 10000 sheets with an image forming apparatus 100 in which any of the process cartridges 7 was mounted in a low-temperature, low-humidity environment (15° C., 10% RH) with a print coverage of 1%.

Subsequently, the process cartridge 7 was set on a torque measuring device, and the driving torque of the photosensitive drum was measured after the 10000-sheet printing.

Also, the degree of dirt on the charging roller 2 after the 10000-sheet printing was visually observed to evaluate the effect of dirt on the resulting image. For the degree of dirt on the charging roller, white dirt coming from the particles M and dirt caused by toner T attached in streaks to the photosensitive drum or the charging roller were each checked for evaluation. The evaluation results are shown in Table 3. In Table 3, good represents that no dirt was observed; fair represents no marked dirt was observed; and bad represents marked dirt was observed.

TABLE 3

| | | | | Charging roller | |
|---|---|---|---|---|---|
| | Toner | Cleaning blade | Torque (N · m) | white dirt | Dirt caused by toner |
| Experimental Example 1 | Toner 1 | Cleaning blade 1 | 0.1 | Good | Good |
| Experimental Example 2 | Toner 1 | Cleaning blade 2 | 0.1 | Good | Good |
| Experimental Example 3 | Toner 1 | Cleaning blade 3 | 0.1 | Good | Good |
| Experimental Example 4 | Toner 1 | Cleaning blade 4 | 0.1 | Good | Good |
| Experimental Example 5 | Toner 2 | Cleaning blade 1 | 0.1 | Good | Good |
| Experimental Example 6 | Toner 2 | Cleaning blade 3 | 0.1 | Good | Good |
| Experimental Example 7 | Toner 1 | Cleaning blade 5 | 0.2 | Fair | Fair |
| Experimental Example 8 | Toner 1 | Cleaning blade 6 | 0.3 | Good | Fair |
| Experimental Example 9 | Toner 2 | Cleaning blade 6 | 0.1 | Good | Fair |
| Experimental Example 10 | Toner 3 | Cleaning blade 1 | 0.2 | Bad | Bad |

As is clear from Table 3, in Experimental Examples 1 to 9, except for Experimental Example 10, using toner particles M having a peculiar shape satisfying the above-specified relationships (toners 1 and 2), the torque was as low as 0.3 N·m or less. Also, in Experimental Examples 1 to 9, dirt (white dirt and dirt caused by toner) influencing the charging roller was not markedly bad or not observed.

Particularly in Experimental Examples 1 to 6 using cleaning blade 1 to 4 having a dynamic hardness within a specific range mentioned above, the torque was further reduced to 0.1 N·m or less and, in addition, the charging roller was not affected.

More specifically, in Experimental Examples 1 to 6, which used toner 1 or 2 and a cleaning blade having a dynamic hardness H satisfying $0.1 \leq H \leq 1.2$, white dirt on the charging roller and dirt on the photosensitive drum and charging roller coming from the toner did not occur. This is probably because particles M capable of reducing friction were retained effectively in the cleaning nip N and thus minimize the contamination of the charging roller with the particles M themselves and prevent the toner remaining after transfer from passing through the nip.

In Experimental Example 7, which uses a cleaning blade having a surface (contact portion 820) with a relatively low harness (0.08 $mN/\mu m^2$), the contact portion 820 is easily bent, and the width of the cleaning nip N tends to increase, as shown in FIG. 3B, This is probably the reason why the torque was slightly increased compared to Experimental Examples 1 to 6 using cleaning blades having a relatively high harness.

In contrast, in Experimental Example 8, which uses a cleaning blade having a surface (contact portion 820) with a relatively high hardness (1.3 mN/$\mu m^2$), the cleaning nip N tends not to sufficiently retain particles M, as shown in FIG. 3C. Consequently, the lubricity of the particles M to reduce friction probably did not function effectively compared to Experimental Examples 1 to 6 using a cleaning blade having a relatively low hardness, and the charging roller was affected to some extent.

In the present embodiment, a toner T (developer) containing toner particles and specific toner particles M having a smaller equivalent sphere diameter than the toner particles is used for developing an electrostatic latent image on a photosensitive drum into a developer image. The cleaning member includes a contact portion to be contact with the photosensitive drum. This contact portion functions to clean the surface of the photosensitive drum. The cleaning member of the present embodiment allows the specific particles M having a peculiar shape to stay at the cleaning nip N with a lubricity to reduce friction in the cleaning nip N, thus preventing the particles and the toner from passing through the cleaning nip and contaminating the members located downstream.

In particular, by integrating the particles M with the surface of the toner particles, a cartridge and an image forming apparatus that enable high quality image formation with a reduced torque can be achieved without adding an external additive or additional fine particles functioning as rollers or adding a fatty acid metal salt functioning to reduce friction.

In particular, particles M containing an organosilicon polymer have a low surface free energy and, accordingly, function readily to reduce friction. Also, organosilicon polymer, which has a lower hardness than inorganic silicon, does not damage the photosensitive drum even though it is retained in the nip.

Furthermore, the peculiar shape of the particles M facilitates the retention of the particles in the cleaning nip N, thus helping the particles exhibit a lubricity sufficient to reduce friction. In at least some embodiment, the dynamic hardness of the contact portion 820 is in the above-mentioned specific range from the viewpoint of easily bending the contact portion 820 as required.

In this instance, the cartridge and the image forming apparatus can realize high quality image formation with a low torque over a long period.

Modification of First Embodiment

In the foregoing first embodiment, the particles M integrated with the surfaces of the base particles of the toner T are separated during development and fed for serving as intended. Alternatively, a particle feeder 11 configured to supply particles M to the photosensitive drum 1 may be provided so as to come into contact with the photosensitive drum 1, as in the modification shown in FIG. 5.

Figure 5:
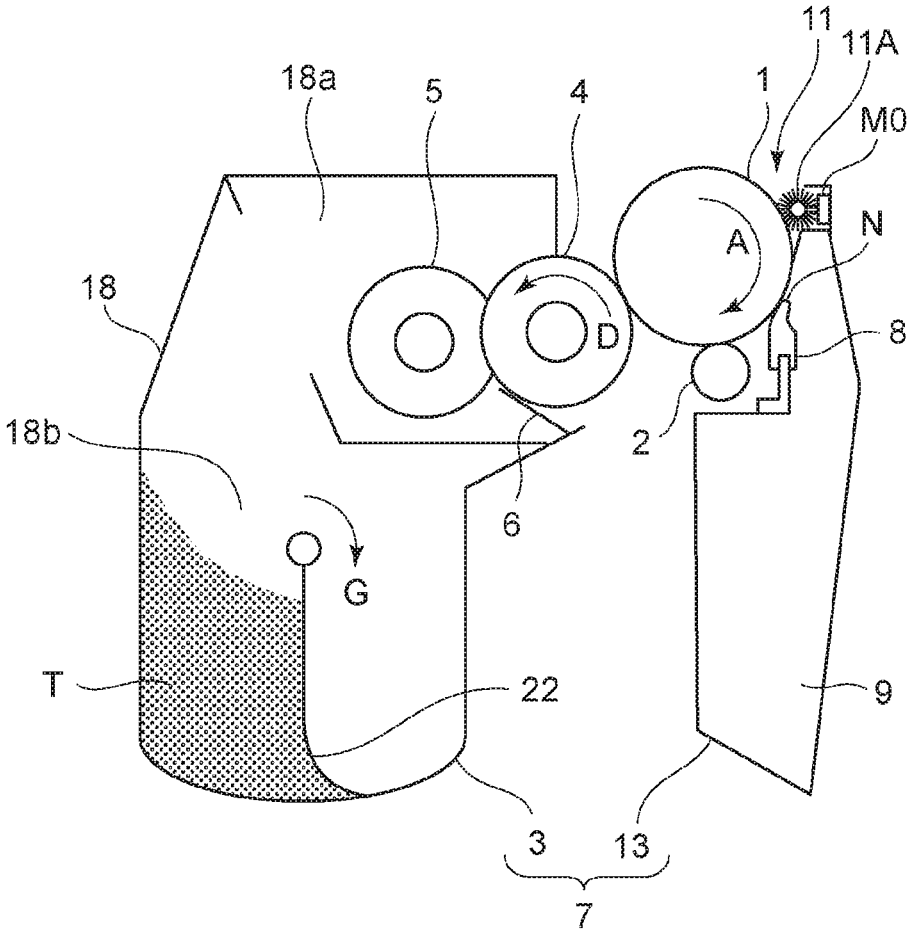
FIG. 5 is a schematic sectional view of the process cartridge of the image forming apparatus according to a modification of the first embodiment.

FIG. 5 is a schematic sectional view of the process cartridge of the image forming apparatus according to a modification of the first embodiment.

In this modification, a particle feeder 11 may include a particle source M0 formed by pelletizing particles M, and a particle feeding brush 11A configured to scrape particles from the particle source MO and apply the particles to the photosensitive drum 1, as shown in FIG. 5.

The particle feeding brush 11A can come into contact with the photosensitive drum 1 so that the particles M can be fed to the photosensitive drum 1 with the particle feeding brush 11A.

Alternatively, the particle feeder 11 may be a porous sponge roll (not shown) containing particles M, and the particles M will be fed to the photosensitive drum 1 by bringing the sponge roll into contact with the photosensitive drum 1. In these cases, the feeding brush 11A or the sponge roll may be provided with a mandrel to which a feeding bias is applied.

The feeding brush 11A or the sponge roll may be provided with a driven member (not shown) that directly receive a driving force from the apparatus body. The feeding brush 11A or the sponge roll may be in removable contact with the photosensitive drum 1.

Second Embodiment

A second embodiment of the present disclosure basically has the same configuration as the first embodiment. Differences will be described below with reference to FIG. 6.

In the second embodiment, the intermediate transfer belt 31 (intermediate transfer member) is cleaned by a cleaning device, while the photosensitive drum is cleaned by the cleaning device (cleaning blade 8) in the first embodiment. The image forming device of the second embodiment has a cleaning device 35A, and the cleaning device 35A may have the same configuration as the cleaning device (cleaning blade 8) in the first embodiment.

Figure 6:
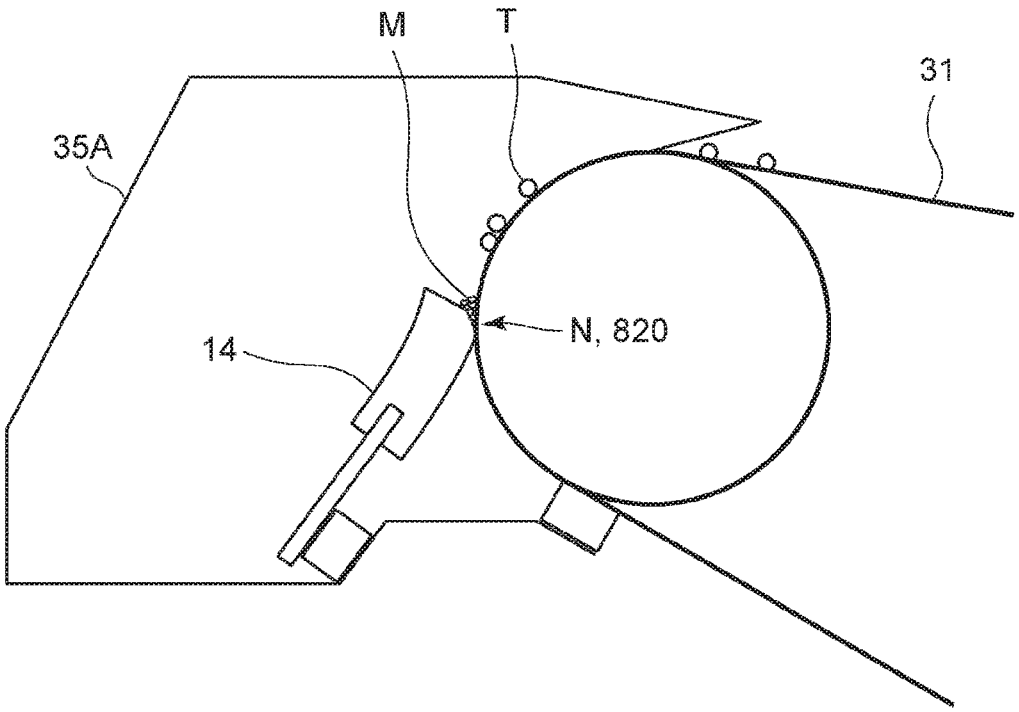
FIG. 6 is an enlarged sectional view of a major part of the image forming apparatus according to a second embodiment of the present disclosure.

FIG. 6 is an enlarged sectional view of a major part of the image forming apparatus of the second embodiment. In the present embodiment, the cleaning device 35A adapted to clean the intermediate transfer member includes a second cleaning blade 14, as shown in FIG. 6. The second cleaning blade 14 may function as the cleaning member disclosed herein as with the cleaning blade 8 in the first embodiment.

More specifically, the image forming apparatus of the present embodiment includes an intermediate transfer member 31 operable to bear the developer to be transferred from the image bearing member, and a cleaning member 35A having a contact portion 820 capable of coming into contact with the intermediate transfer member to clean the surface of the intermediate transfer member, The cleaning member is configured to retain the specific particles M having a smaller equivalent sphere diameter than the toner particles of the developer T at a contact region N where the intermediate transfer member and the contact portion 820 come into contact with each other.

The specific particles M contain an organosilicon polymer having a partial structure represented by R—$SiO_{3/2}$, wherein R represents an alkyl group having 1 to 6 carbon atoms. In the specific particles, when the total of the atomic concentration dSi of silicon, the atomic concentration dO of oxygen, and the atomic concentration dC of carbon, is measured to be 100.0 atomic % by electron spectroscopy of chemical analysis (LSCA), the atomic concentration dSi of silicon satisfies the relationship 1.0 atomic % ≤dSi≤29.0 atomic %.

Also, the specific particles satisfy L2/L3≤3/4 or L2/L3≥4/3 when assuming that the specific particles have three lengths L1, L2, and L3 in three axis direction in a three-dimensional coordinate system, wherein L1 is the longest one of the three lengths, in an average value of a unit volume (see FIGS. 4A to 4D).

In at least some implementations according to the present embodiment, the contact portion may have a dynamic hardness H satisfying 0.1≤H≤1.2 as in the first embodiment.

The image forming apparatus of the present embodiment can produce the same effect as in the first embodiment.

In the present embodiment, the cartridge and the image forming apparatus allow the torque at the cleaning nip to be reduced and reduce defects in the resulting imagery.

While the present invention has been described with reference to exemplary embodiments, it is to be understood. that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-240747 filed Dec. 15, 2017 and No. 2018-204523 filed Oct. 30, 2018, which are hereby incorporated by reference herein in their entirety.

What is claimed is:

1. A cartridge comprising:

an image bearing member operable to bear a developer image formed by developing an electrostatic latent image with a developer containing toner particles and specific particles, the specific particles having a smaller equivalent sphere diameter than the toner particles, and a cleaning member having a contact portion that is operable to contact with the image bearing member in a contact region and is operable to clean the surface of the image bearing member, the cleaning member being configured to be able to retain the specific particles in the contact region, wherein the specific particles contain an organosilicon polymer having a partial structure represented by $R—SiO_{3/2}$, wherein R represents an alkyl group having 1 to 6 carbon atoms, and the atomic concentration dSi of silicon in the specific particles satisfies the relationship 1.0 atomic %≤dSi≤29.0 atomic %, when the total atomic concentration of silicon, oxygen, and carbon in the specific particles is measured to be 100.0 atomic % by electron spectroscopy for chemical analysis (ESCA), and wherein the specific particles satisfy L2/L3≤3/4 or L2/L3≥4/3, when assuming that the specific particles have three lengths L1, L2, and L3 in three axis directions in a three-dimensional coordinate system, wherein L1 is the longest one of the three lengths, in an average value of a unit volume.

2. The cartridge according to claim 1, wherein the contact portion has a dynamic hardness H satisfying 0.1≤H≤1.2.

3. The cartridge according to claim 1, further comprising a developer bearing member operable to feed the developer to the image bearing member, wherein the specific particles are bound to the surfaces of the toner particles so as to form an integrated structure, thus being fed together with the toner particles from the developer bearing member to the image bearing member.

4. The cartridge according to claim 3, wherein the specific particles, being separated from the surface of the toner particles during image formation, are retained in the contact region.

5. The cartridge according to claim 1, further comprising a developer bearing member operable to feed the developer to the image bearing member, wherein the specific particles are an external additive mixed with the toner particles, thus being fed together with the toner particles from the developer bearing member to the image bearing member.

6. The cartridge according to claim 1, further comprising a developer bearing member operable to feed the developer to the image bearing member, wherein, the developer bearing member includes a surface layer containing the specific particles, the specific particles being fed to the image bearing member from the surface layer of the developer bearing member.

7. The cartridge according to claim 3, wherein the developer bearing member is an elastic roller operable to feed the developer to the image bearing member via contact with the image bearing member.

8. The cartridge according to claim 1, wherein the cleaning member comprises an elastic plate having a free end, and the contact portion is located at the free end of the elastic plate.

9. The cartridge according to claim 1, further comprising a particle feeder in contact with the image bearing member, the particle feeder being operable to feed the specific particles to the image bearing member.

10. The cartridge according to claim 9, wherein the particle feeder includes a brush capable of feeding the specific particles to the image bearing member via contact with the image bearing member.

11. The cartridge according to claim 1, wherein the developer contains a magnetic mono-component toner.

12. The cartridge according to claim 1, wherein the cartridge is configured to be detachably mountable to an image forming apparatus operable to form images.

13. An image forming apparatus comprising:

a fixing device; and the cartridge as set forth in claim 1.

14. An image forming apparatus comprising:

an image bearing member operable to bear a developer image formed by development using a developer containing toner particles and specific particles, the specific particles having a smaller equivalent sphere diameter than the toner particles;

an intermediate transfer member operable to bear the developer image transferred from the image bearing member; and a cleaning member having a contact portion that is operable to contact with the intermediate transfer member in a contact region and is operable to clean the surface of the intermediate transfer member, the cleaning member being configured to be able to retain the specific particles in the contact region, wherein the specific particles contain an organosilicon polymer having a partial structure represented by $R—SiO_{3/2}$, wherein R represents an alkyl group having 1 to 6 carbon atoms, and the atomic concentration dSi of silicon in the specific particles satisfies the relationship 1.0 atomic % ≤dSi≤29.0 atomic %, when the total atomic concentration of silicon, oxygen, and carbon in the specific particles is measured to be 100.0 atomic % by electron spectroscopy for chemical analysis (ESCA), and wherein the specific particles satisfy L2/L3≤3/4 or L2/L3≥4/3 when assuming that the specific particles have three lengths L1, L2, and L3 in three axis directions in a three-dimensional coordinate system, wherein L1 is the longest one of the three lengths, in an average value of a unit volume.

15. The image forming apparatus according to claim 14, wherein the contact portion has a dynamic hardness H satisfying 0.1≤H≤1.2.

* * * * *